US005400927A

United States Patent [19]

Marchadour

[11] Patent Number: 5,400,927

[45] Date of Patent: Mar. 28, 1995

[54] LIQUID/FLOWABLE PRODUCT FILLING APPARATUS WITH SEAL SYSTEM

[76] Inventor: Jean C. Marchadour, 2460 Granite Pl., Sandy, Utah 84092

[21] Appl. No.: 267,172

[22] Filed: Jun. 27, 1994

Related U.S. Application Data

[63] Continuation of Ser. No. 978,212, Nov. 17, 1992, abandoned.

[51] Int. Cl.[6] ..... B67D 5/46

[52] U.S. Cl. ..... 222/380; 222/501; 222/509; 222/542; 222/309; 251/277; 277/110; 277/198; 277/103

[58] Field of Search ..... 251/324, 359, 361; 277/110, 112, 198, 103, 192, 199, 205, 119; 222/287, 149, 309, 380, 501, 509, 542, 559

[56] References Cited

U.S. PATENT DOCUMENTS

| | | | |
|---|---|---|---|
| 3,168,225 | 2/1965 | Miller et al. | 222/380 |
| 3,252,619 | 5/1966 | Miller | 222/309 X |
| 3,807,909 | 4/1974 | St. Clair | 222/380 X |
| 3,850,345 | 11/1974 | Merritt | 222/380 X |
| 3,865,281 | 2/1975 | Byrd et al. | 222/309 X |
| 4,501,622 | 2/1985 | Marchadour | 134/18 |
| 4,602,964 | 7/1986 | Marchadour | 134/18 |
| 4,708,269 | 11/1987 | Willerding | 222/309 X |
| 4,844,481 | 7/1989 | Marchadour | 277/73 |
| 5,092,492 | 3/1992 | Centea | 222/309 X |
| 5,195,656 | 3/1993 | Briehl et al. | 222/309 X |

FOREIGN PATENT DOCUMENTS

| | | | |
|---|---|---|---|
| 1929589 | 4/1979 | Germany | 222/380 |
| 1520346 | 11/1989 | U.S.S.R. | 222/380 |

*Primary Examiner*—Andres Kashnikow
*Assistant Examiner*—Kenneth Bomberg
*Attorney, Agent, or Firm*—Thorpe North & Western

[57] ABSTRACT

A sealing system for use in a liquid/flowable product filling apparatus which comprises a hopper for holding the product, one or more filling assemblies, each of which includes a nozzle, a cylinder, a valve for selectively passing product from the hopper to the cylinder and from the cylinder to the nozzle, a piston selectively moveable in the cylinder to draw product from the hopper through the valve into the cylinder or to push product from the cylinder into the valve and out of the nozzle, and a plunger selectively moveable in the valve to prevent the flow of product from the hopper into the valve or prevent the flow of product from the valve and out of the nozzle. The sealing system includes an annular piston seal circumscribing the piston to press against the cylinder walls to provide a seal therebetween. The valve includes an annular wall section through which the plunger moves, and an annular recess formed in the wall section. An annular valve seal is disposed in the recess formed in the annular wall section to press against the plunger as it moves through the wall section, to provide a seal therebetween.

16 Claims, 4 Drawing Sheets

LIQUID/FLOWABLE PRODUCT FILLING APPARATUS WITH SEAL SYSTEM

This application is a continuation of U.S. application Ser. No. 07/978,212, filed Nov. 17, 1992, of Jean Charles Marchadour for LIQUID/FLOWABLE PRODUCT FILLING APPARATUS WITH SEAL SYSTEM, now abandoned.

BACKGROUND OF THE INVENTION

The present invention relates to a liquid/product filling apparatus which utilizes a combination of pistons, cylinders and valves with a seal system for effectively preventing leakage of liquid or flowable products being handled by the apparatus.

Apparatus and process for automatically filling containers, such as cans and bottles, with both food and non-food products have become very sophisticated and efficient. Such apparatus and processes are used to fill containers with liquid, semi-liquid, pasty or products which might contain food products, such as liver paste, baby foods, jellies, vegetable oil, mustard, sauces, etc. and non-foods, such as mineral oil, wax, paints, etc. The apparatus used and the processes employed may take a variety of forms, one of the most popular being the so-called rotary piston filler, examples of which are disclosed in U.S. Pat. Nos. 4,501,622 and 4,602,964.

Rotary fillers typically include a generally cylindrical hopper made, for example, of stainless steel, a number of filling assemblies spaced apart about the exterior of the hopper, and a container or can conveying system for moving cans into position underneath the filling assemblies to receive product. The filling assemblies each typically include a vertically disposed cylinder, a valve coupling the lower end of the cylinder to the hopper and operable to either allow material to flow from the hopper into the cylinder or to flow from the cylinder into a can positioned below the valve, and a piston moveable in the cylinder to force material from the cylinder into the can. Rotary fillers also typically include a piston support structure for causing the pistons to move upwardly in the cylinders when product is flowing from the hopper into the cylinders, and downwardly when product is being forced from the cylinder into cans. See the aforecited U.S. Pat. Nos. 4,501,622 and 4,602,964.

An important aspect of rotary fillers such as described above is the seal system utilized to prevent leakage and flow of product to other than desired destinations to thus prevent contamination, maintain cleanliness, and reduce the loss and waste of product. One seal structure which has oftentimes been used in rotary fillers (and in many other applications) is the conventional O-ring. However, when used with the pistons, cylinders and valves employed in rotary fillers, it has been found difficult to keep the product from leaking or escaping behind the O-rings, especially if the product is liquid or flowable. Multiple O-rings are generally required to alleviate the problem of leakage in both piston and rotary valves and to provide proper sealing of pistons to develop adequate suction when the piston is used to draw food from the hopper to the cylinder prior to discharge of the food into a can.

The prior pistons and valves utilizing O-ring seals also present a problem during cleaning. Automatic cleaning systems have been suggested, as described in U.S. Pat. No. 4,502,622, for cleaning rotary fillers but if conventional O-ring seals were used in such fillers, it would be difficult to properly clean such seals. In fact, health concerns would generally require that these conventional O-ring seals be cleaned by hand since the O-rings would have to be removed from retainer grooves to clean both the O-rings and the grooves. This, of course, would negate some of the advantages of the automatic cleaning system.

One approach to overcoming, or at least alleviating, some of the problems of existing seal systems, as set forth in U.S. Pat. No. 4,844,481, which discloses a cylindrical seal system which utilizes O-rings in a manner which effectively prevents leakage and also allows for automated cleaning of the system. The present invention is a further improvement of this cylindrical seal system and seal systems especially adapted for use with rotary fillers.

SUMMARY OF THE INVENTION

It is an object of the invention to provide a new and improved seal system especially adapted for use in liquid/flowable product filling apparatus.

It is also an object of the invention to provide a complete liquid/flowable product filling apparatus which efficiently prevents leakage and movement of product except to selected destinations.

It is another object of the invention to provide a seal system in a rotary product filling apparatus in which the seal components may be readily removed and cleaned.

It is an additional object of the invention to provide such a seal system in which the component parts may be readily manufactured, assembled and disassembled.

The above and other objects of the invention are realized in a specific illustrative embodiment of a seal system especially adapted for use in a liquid/flowable product filling apparatus which includes a hopper for holding the product, and one or more filling assemblies. Each of the filling assemblies includes a nozzle, a cylinder, a valve for selectively passing product from the hopper to the cylinder and from the cylinder to the nozzle, a piston selectively moveable in the cylinder to draw product from the hopper through the valve into the cylinder or to push product from the cylinder into the valve and out of the nozzle, and a plunger selectively moveable in the valve to prevent the flow of product from the hopper into the valve or prevent the flow of product from the valve out of the nozzle. The valve includes an annular wall section through which the plunger moves and an annular recess formed in the wall section. The seal system includes an annular piston seal circumscribing the piston to press outwardly against the cylinder walls as the piston slides in the cylinder. Also, an annular valve seal is included in the recess of the wall section to press against the plunger as it moves through the wall section.

In accordance with one aspect of the invention, the piston seal includes a resilient annulus having sidewalls with upper and lower vertically spaced-apart, inwardly projecting lips, and a support ring comprised of three arcuate segments which, when placed end-to-end, form a ring for disposition within the annulus between the upper and lower lips and against the sidewall of the annulus. The support ring includes at least one annular recess formed on the exterior concave surface to circumscribe the support ring and for receiving an O-ring. With this combination, the O-ring presses outwardly against the sidewall of the annulus to force the annulus against the cylinder walls.

In accordance with another aspect of the invention, the valve seal includes an annular seal element having a U-shaped cross-section whose opening faces radially outwardly, and having an interior annular wall disposed radially inwardly from the opening. The valve seal also includes an annular support collar disposed in the opening of the seal element, with the support collar including an inwardly facing annular groove which circumscribes the interior annular wall of the seal element. A resilient O-ring is disposed in the groove of the support collar to press against the interior wall of the seal element and force it radially inwardly against the exterior wall of the plunger.

With the above-described configurations, all O-rings are placed in unexposed locations so that product will not contact the O-rings to subsequently require cleaning. Also, the various seals are constructed of few component parts and may be readily assembled and disassembled.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
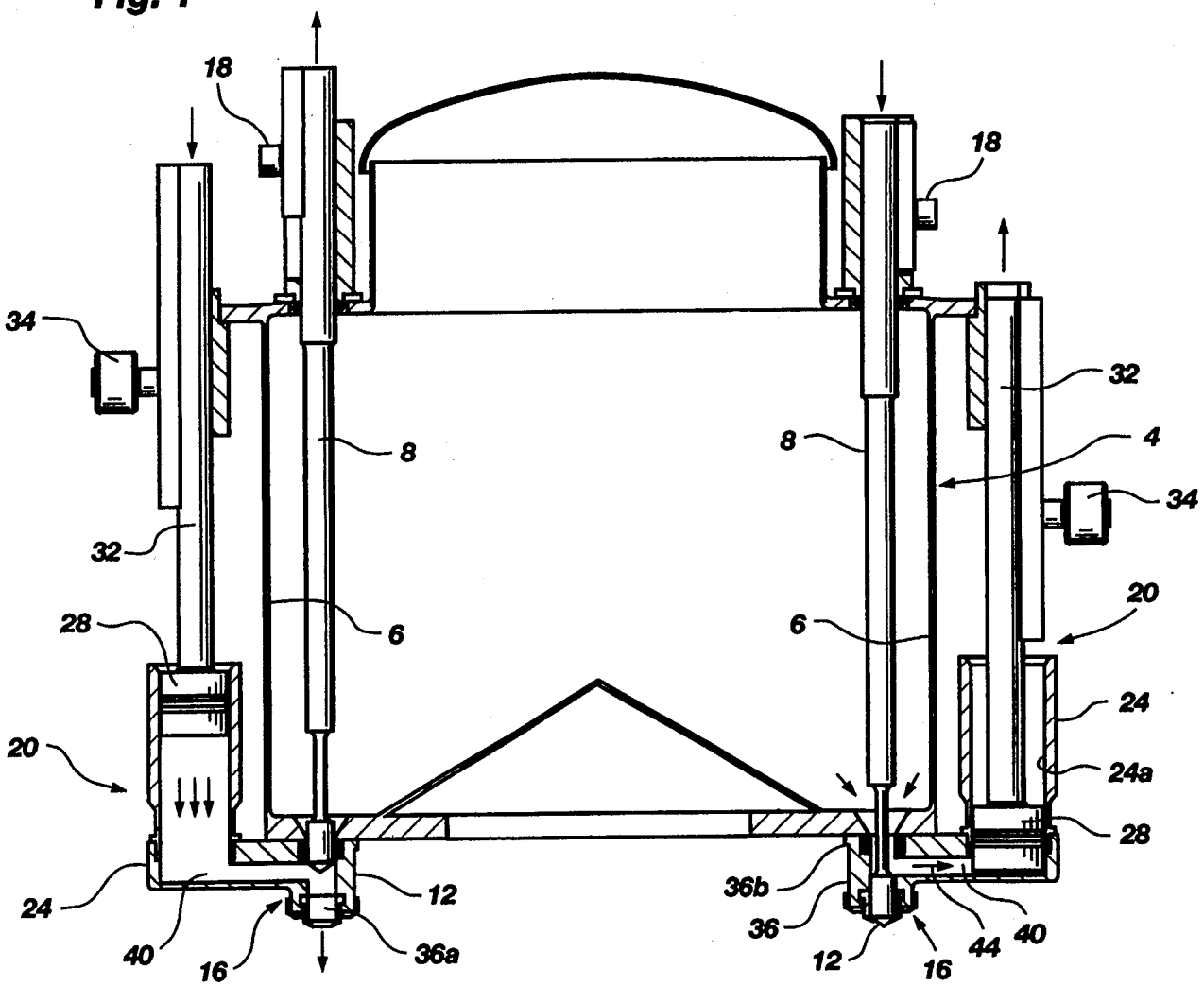
FIG. 1 shows a side, cross-sectional view of a rotary liquid/flowable material filler made in accordance with the principles of the present invention.

Referring to FIG. 1, there is shown a side, cross-sectional view of a rotary liquid filler which includes a generally cylindrical hopper 4 in which are disposed valve rods 8 at spaced-apart locations within the hopper but near the wall 6 thereof. Attached to the lower end of each of the valve rods 8 are valve plungers 12 disposed to move within discharge valves 16. The valve rods 8 are controlled by cam followers 18 (fitted to move along camming paths not shown) to move upwardly or downwardly and thereby move the valve plungers 12 between a discharge position (shown at the left in FIG. 1) and an aspiration or suction position (shown at the right in FIG. 1). The use of cam followers and camming tracks to control the movement of valves and pistons is well-known in the rotary filler apparatus field. See, for example, the aforecited U.S. Pat. Nos. 4,501,622 and 4,602,964, and U.S. Pat. No. 3,168,225.

Disposed on the outside of the hopper 4 are a plurality of piston assemblies 20, each of which includes a dosing cylinder 24 having an interior cylinder wall **24*a*, and in which is disposed a dosing piston 28 mounted on the lower end of a piston rod 32. The piston rod 32, like the valve rods 8, is controlled to move upwardly and downwardly by a cam follower 34 following a camming track (not shown). This, in turn, causes the dosing piston 28 to move upwardly and downwardly within the dosing cylinder 24** for reasons to be discussed momentarily.

Each valve 16 includes a discharge passageway 36, formed to be generally cylindrical and having an outlet port **36*a* and an inlet port 36*b*. Extending between the discharge passageway and the interior of the cylinder 24 is a connecting passageway 40. The connecting passageway 40 connects to the discharge passageway 36 at a location between the outlet port 36*a* and the intake port 36*b***.

The valves 16 and piston assemblies 20 operate to discharge liquid or flowable material from inside the hopper 4 into a can or bottle which would be located below the valves 16. The valve 16 and piston assembly 20 at the right in FIG. 1 are shown, as indicated earlier, in the aspiration or suction position in which material from inside the hopper 4 flows through the valve and into the cylinder 24 as the piston 28 is raised to draw material into the cylinder (as indicated by the arrow 44). After the appropriate material dosage to be delivered to a can or bottle has been drawn into the cylinder 24, the valve plunger 12 is raised by the valve rod 8 to the discharge position, as shown at the left in FIG. 1, and the piston 28 is then moved downwardly in the cylinder 24 to move or discharge the material through the connecting passageway 40 and out the valve outlet **36*a*** into a can or bottle located under the valve.

Figure 2:
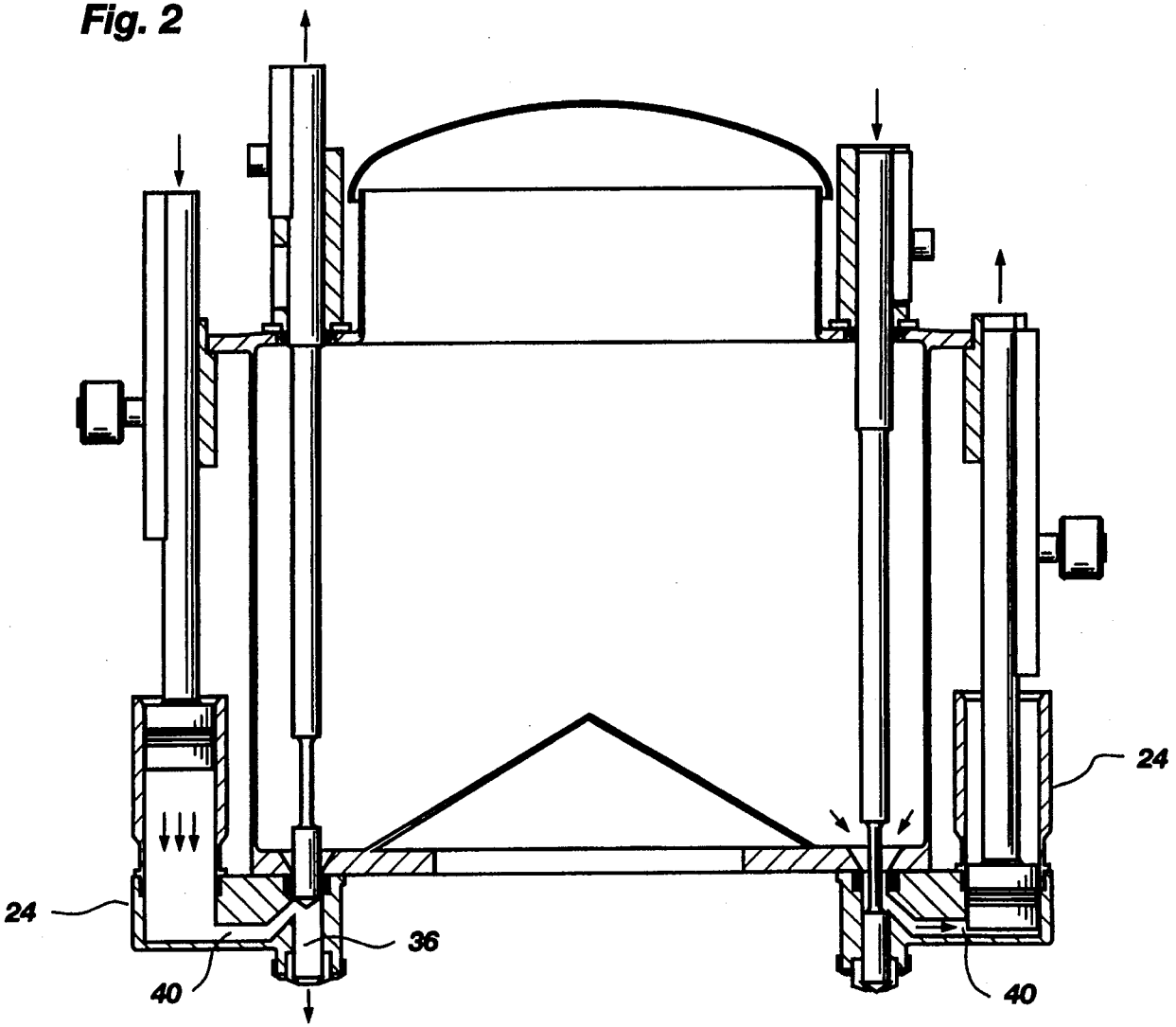
FIG. 2 shows a side, cross-sectional view of an alternative embodiment of a rotary filler made in accordance with the principles of the present invention.

FIG. 2 shows a side, cross-sectional view of an alternative embodiment of a rotary liquid filler similar to that shown in FIG. 1, but wherein the connecting passageways 40 extend from the interior of the cylinder 24 generally horizontally and then upwardly at an angle from the horizontal to join the discharge passageway 36. This configuration of the connecting passageway 40 serves to prevent leaking and dripping of material from the connecting passageway 40 and out the discharge passageway 36, as might otherwise occur if the connecting passageway were horizontal over its entire length, as in FIG. 1.

Figure 3:
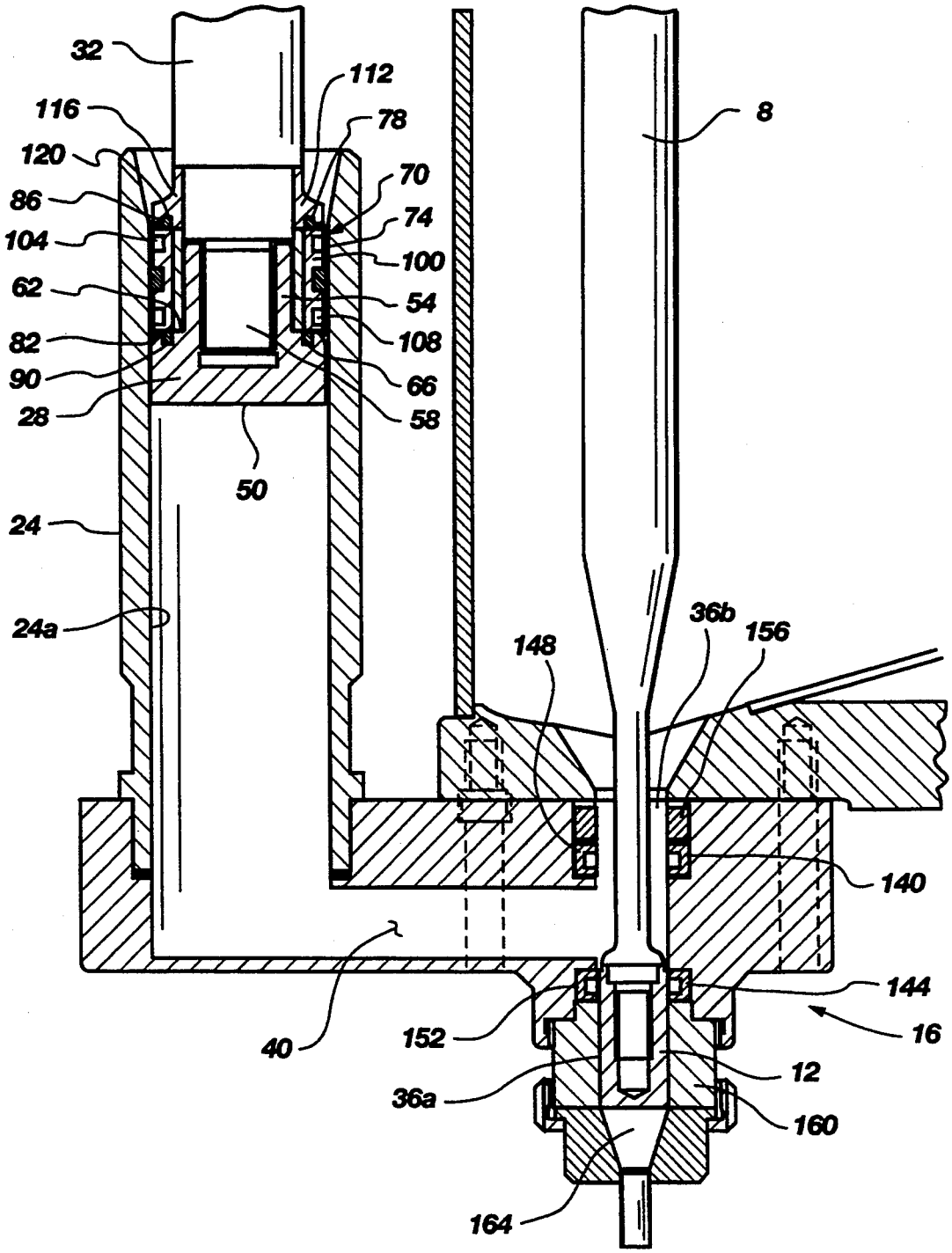
FIG. 3 is a side, cross-sectional, fragmented view showing details of the piston seal and valve seal made in accordance with the present invention.

FIG. 3 is a side, cross-sectional, fragmented view showing details of a valve and piston assembly, including a valve seal and piston seal, respectively, made in accordance with the principles of the present invention. The piston 28, shown in cross-sectional view in FIG. 3 and with slight variation in exploded view in FIG. 4A, includes a cylindrical base on which is formed an upwardly projecting cylindrical boss 54 having a cylindrical hollow 58 therewithin and defining, between the boss 54 and base 50, a shoulder 62. Formed in the shoulder 62 to circumscribe the boss 54 is a groove 66. The base 50 and boss 54 might advantageously be made of polyurethane or similar synthetic, wear resistant material.

Figure 4A:
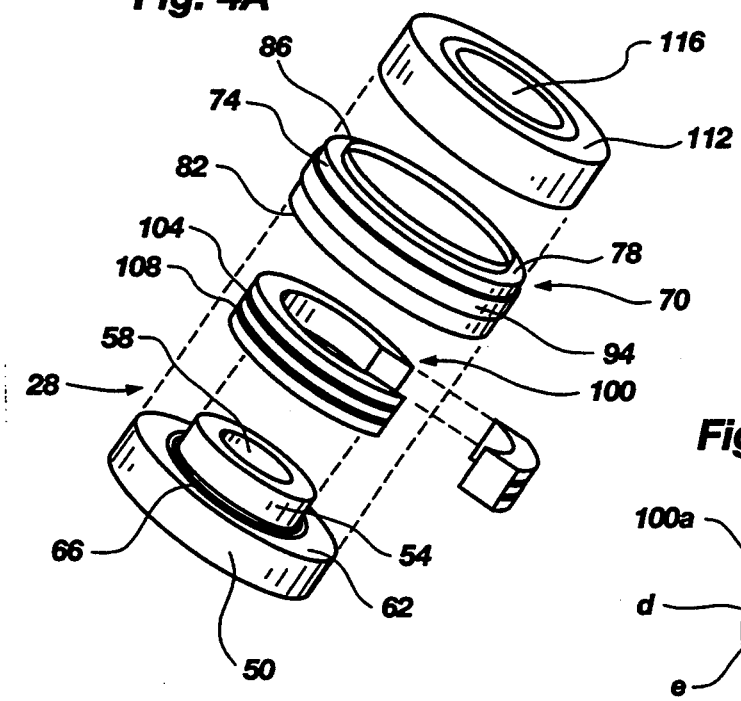
FIG. 4A is an exploded, perspective view of a piston seal made in accordance with the present invention.

The seal system for the dosing piston 28 includes and outer resilient annulus 70 having an annular sidewall 74, with an upper inwardly projecting lip 78 and a lower inwardly projecting lip 82. Projecting upwardly from the upper lip 78 is an annular ridge 86, and projecting downwardly from the lower lip 82 is a lower annular ridge 90. The lower annular ridge 90 is dimensioned to fit into the groove 66 formed in the shoulder 62 of the base 50, as shown in FIG. 3. Optionally, an annular rib 94 projects radially outwardly from the sidewall 74 of the annulus 70, as shown in FIG. 4A (but not FIG. 3). Advantageously, the annulus 70 is made of an elastomeric material such as polytetrafluoroethylene, or similar material.

Figure 4B:
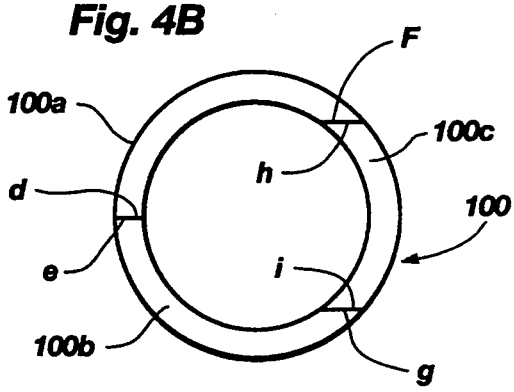
FIG. 4B is a top plan view of the of the support ring shown in FIG. 4A.

Formed to fit within the annulus 70 between the upper lip 78 and lower lip 82 is an annular support ring 100. The support ring 100 which, for example, may be made stainless steel, is formed of three arcuate pieces which, as shown in FIG. 4B, when fitted together end to end form a ring. Formed in the outer convex surface of this ring are two annular grooves 104 and 108 extending circumferentially about the ring. The grooves 104 and 108 are provided for receiving conventional resilient O-rings to press against and urge radially outwardly the sidewall 74 of the annulus 70, when the support ring 100 is fitted therewithin. The sidewall 74, in turn, is urged radially outwardly against the cylinder wall 24*a* (FIG. 3) to provide the desired seal between the dosing piston 28 and the cylinder wall.

Because the outer circumference of the support ring 100 is greater than the inner circumferences of the upper lip 78 and lower lip 82 of the annulus 70, it would be difficult to fit the support ring within the annulus if the support ring were constructed of a single unitary piece of material. For this reason, the support ring 100 is formed of three arcuate pieces 100*a*, 100*b* and 100*c*, as shown in top plan view in FIG. 4B. Arcuate pieces or segments 100*a* and 100*b* are formed with abutting end cuts d and e respectively which are generally perpendicular to the circumference of the support ring 100. The opposite ends of arcuate segments 100*a* and 100*b* are formed with end cuts f and g respectively which are parallel with one another and with the end cuts d and e. Finally, arcuate segment 100*c* is formed with end cuts h and i which are parallel with one another and with the end cuts f and g of arcuate segments 100*a* and 100*b* respectively.

With this configuration, arcuate segments 100*a* and 100*b* may first be fitted within the annulus 70 and located in an abutting end-to-end configuration as shown in FIG. 4B. The arcuate segment 100*c* may then be inserted within the annulus 70 and then slid radially outwardly into its position shown in FIG. 4B to complete the annular configuring of the support ring 100. The annulus 70 and support ring 100 may then be placed onto the base 50, with the boss 54 extending upwardly within the inner circumference of the support ring 100 to maintain the arcuate segments 100*a*, 100*b* and 100*c* of the support ring in place within the annulus.

The final piece of the dosing piston 28 of FIGS. 3 and 4*a* is a cylindrical top section 112 having a cylindrical opening 116 formed therein. An annular groove 120 (FIG. 3) is formed in the bottom surface of the top section 112 to receive the upper annular ridge 86 of the annulus 70 to thereby hold the top section onto the annulus. Advantageously, the top section 112 is made of polyurethane or a similar wear-resistent synthetic material.

The dosing piston 28 is attached to the piston rod 32 by inserting the rod through openings 116 of the top section 112 and into the hollow of the base 50, where it is screwed into place (compatible threads are formed on the end of the piston rod 32 and in the hollow 58).

The valve seal of the valve 16 (FIG. 3) includes a pair of annular seals 140 and 144. The annular seal 140 is disposed in an annular recess 148 formed in the cylindrical wall of the inlet port 36*b*. Similarly, the annular seal 144 is disposed in an annular recess 152 formed in the cylindrical wall of the outlet port 36*a*. The seal 140 is maintained in place by a retaining ring 156, whereas the seal 144 is held in place by a cylindrical nozzle body 160. The nozzle body includes a central hollow 164 through which product to be delivered to a can or container is moved when the dosing piston 28 is forced downwardly to move product from the dosing cylinder 24.

Figure 5:
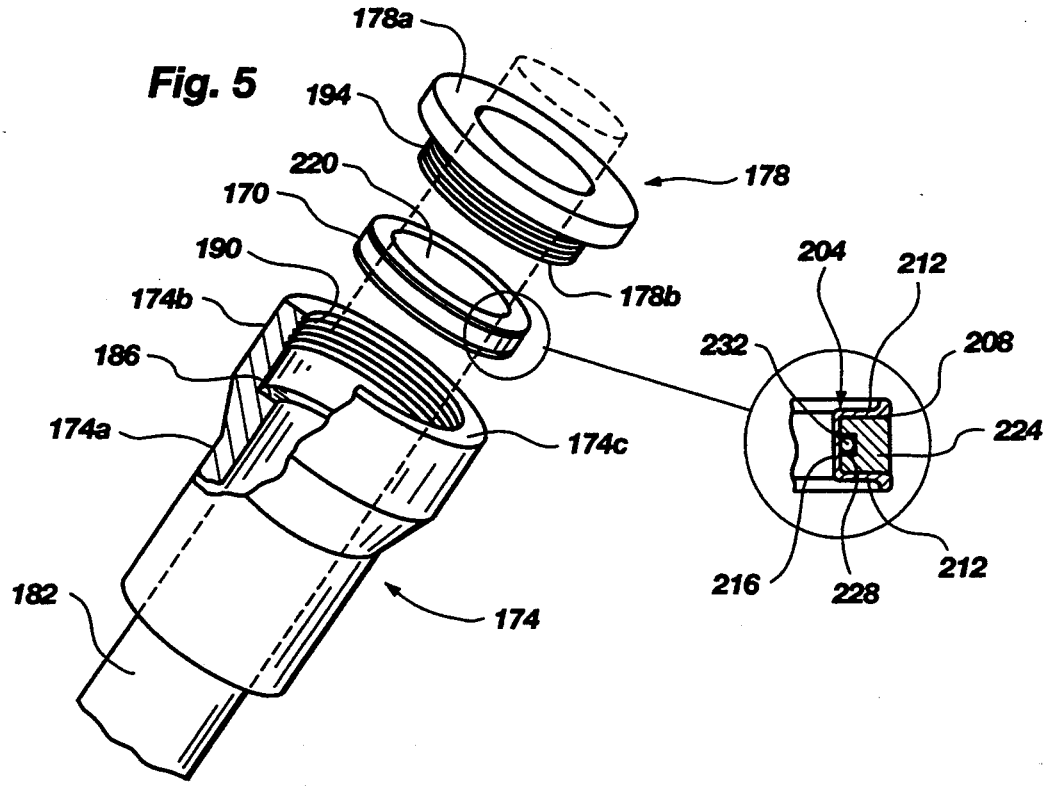
FIG. 5 is an exploded, perspective view of a valve seal made in accordance with the present invention.

An exemplary configuration for holding annular seals in place about an outlet port or inlet port is shown in exploded view in FIG. 5. There, an annular seal 170, of the same construction as annular seals 140 and 144 of FIG. 3, is dimensioned for disposition in a cylinder or port seal housing 174, to be held in place by an annular seal retainer 178. The cylinder seal housing section 174 is formed with a first section 174*a* having a first interior hollow diameter for snugly receiving a cylindrical body 182 which might, for example, be the valve plunger 12. The cylinder seal housing section 174 includes a second section 174*b* extending axially from the first section 174*a* to terminate in a free end 174*c*. The second section 174*b* includes a hollow having an enlarged diameter over that of the first section 174*a* to define a shoulder 186. The inside wall of the second section 174*b* near the free end 174*c* includes threads 190.

The seal retainer 178 is formed with an annular forward end 178*a* and a circumferentially smaller annular rearward end 178*b*. The exterior surface of the rearward end 178*b* includes threads 194 which are compatible with threads 190 to allow screwing the seal retainer 178 into the free end 174*c* of the cylinder seal housing 174. When the seal retainer 178 is screwed into the cylinder seal housing 174, the rearward end 178*b*, interior cylinder wall of the second section 174*b* of the cylinder seal housing and shoulder 186 define an annular channel between the seal retainer 178 and cylinder seal housing 174. It is in this annular channel that the annular seal 170 is disposed to provide a seal between the cylinder seal housing 174 and the cylinder body 182.

The annular seal 170 is formed to include an annular flexible channel member 204 which defines a channel having a radially outwardly facing opening 208, sidewalls 212 and an interior wall 216 circumscribing a central hollow 220. A plurality of ridges (not shown) project radially inwardly from the interior wall to contact the exterior wall of the plunger 12 when the ridges are adjacent to the plunger. The diameter of the central hollow 220 is generally the same as the diameter of the hollow of the first section 174*a* of the cylinder seal housing 174 to allow the cylindrical body 182 to slide therethrough. An annular support collar 224 is disposed in the channel defined by the annular channel member 204. The support collar, which might illustratively comprise two semicircular parts fitted together to form the annular collar, includes an annular groove formed in the inward facing wall of the support collar and adjacent the interior wall 216 of the annular channel member 204. Disposed in the annular groove 228 is a resilient O-ring 232, positioned to press against the interior wall 216 of the annular channel member 204 and force the interior wall radially inwardly against the cylindrical body 182 to form a seal therewith.

Advantageously, the annular channel 204 is made of polytetrafluoroethylene, the support collar 224 is made of stainless steel, and the O-ring 232 is made of an elastomeric material.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A liquid/flowable product filling apparatus comprising a hopper for holding a product, and at least one filling apparatus, each including a dosing cylinder having an interior cylinder wall, a dosing piston disposed in the cylinder to move between a fill position, in which product is drawn into the cylinder, and a dosing position, in which product is moved from the cylinder, a discharge nozzle, a discharge valve defining a first passageway between the hopper and discharge nozzle, and a second passageway between the first passageway and the dosing cylinder, and a plunger having an exterior wall and moveable in the first passageway between a discharge position, in which the plunger prevents the flow of product from the hopper into the first passageway and allows the flow of product from the cylinder through the second passageway and out of the discharge nozzle, and an aspiration position, in which the plunger is disposed in the discharge nozzle to prevent the flow of product therethrough and allow the flow of product from the hopper through the first passageway and second passageway into the cylinder, wherein said dosing piston includes an exterior wall, and an annular piston seal disposed in the exterior wall to seal against the interior cylinder wall, and wherein said first passageway includes an interior wall circumscribing the plunger, at least one annular recess formed in the interior wall at a certain location in the first passageway, and an annular wall seal disposed in each recess to press against the exterior wall of the plunger when the plunger is moved to said certain location, each annular seal comprising:

an annular channel housing having a generally U-shaped cross-section with a channel opening facing radially outwardly and an interior wall disposed opposite the opening, said housing being made of a flexible material.

2. Apparatus as in claim 1 wherein said first passageway includes a valve intake port disposed between the hopper and the second passageway, and a valve outlet port disposed between the second passageway and the nozzle, wherein the plunger is positioned in the valve intake port when in the discharge position, and in the valve outlet port when in the aspiration position.

3. Apparatus as in claim 2 wherein said at least one annular recess comprises a first annular recess disposed in the valve intake port, and a second annular recess disposed in the valve outlet port, and wherein said annular wall seal comprises a first annular seal disposed in the first annular recess to press against the exterior wall of the plunger when the plunger is disposed in the valve intake port, to prevent the flow of product between the exterior wall of the plunger and the valve intake port, and a second annular seal disposed in the second annular recess to press against the exterior wall of the plunger when the plunger is disposed in the valve outlet port, to prevent the flow of product between the exterior wall of the plunger and the valve outlet port.

4. Apparatus as in claim 3 wherein said first and second annular seals each further comprises an annular support collar for disposition in the annular channel housing, said support collar including a groove formed in the inside surface of the support collar to circumscribe the interior wall of the channel housing, and a resilient O-ring disposed in the groove of the support collar to press against the interior wall of the channel housing and force it radially inwardly to press against the exterior wall of the plunger when adjacent thereto.

5. A cylindrical seal assembly for defining a cylindrical chamber for sealingly and slidingly receiving a cylindrical body, said cylindrical seal assembly comprising a first cylindrically hollow member having a first section with a first hollow diameter for snugly receiving the cylindrical body, and a second section extending axially from the first section to terminate in a free end, said second section having an enlarged hollow diameter and interior threads at the free end, a second cylindrically hollow member having a forward end and a rearward end, the exterior of the rearward end including threads compatible with the threads of the hollow of said section to allow screwing the second member into the hollow of the second section of the first member to a certain distance spaced from the first section to define an annular channel between the first section and the second member, and an annular seal for disposition in the annular channel to seal against the cylindrical body when the cylindrical body is inserted in the cylindrical chamber, said annular seal including an annular flexible channel member comprising a channel having a radially outwardly facing opening, and an interior wall circumscribing a central hollow whose diameter is generally the same as said first hollow diameter, a support collar for disposition in the channel of the channel member, said support collar including an annular groove formed in an interior wall of the support collar, adjacent the interior wall of the channel member, and an O-ring disposed in the groove to press against the interior wall of the channel member and force the interior wall against the cylindrical body to form a seal therewith.

6. Apparatus as in claim 4 wherein said channel housing is made of an elastomeric material wherein said support collar is made of stainless steel, and wherein said O-ring is made of an elastomeric material.

7. Apparatus as in claim 2 wherein said piston seal comprises a cylindrical seal housing having a central section which includes an outer resilient annulus having an annular sidewall with upper and lower lips projecting inwardly from the top and bottom respectively of the sidewall, a support ring dimensioned for disposition within the annulus between the upper and lower lips and against the sidewall, said support ring being comprised of three arcuate segments for assembly within the annulus end-to-end to form a ring, the outer convex surface of the support ring including at least one groove extending circumferential about the ring, and one or more resilient O-rings disposed in the grooves to press against the sidewall of annulus.

8. Apparatus as in claim 7 wherein two of the support ring segments are formed with abutting ends having end cuts which are perpendicular to a tangent of the arcuate segments at a position at which the ends abut, and with free ends having end cuts parallel with one another and with the end cuts of the abutting ends, and wherein the third support ring segment is formed with end cuts which are parallel with one another and with the end cuts of the free ends of said two segments, to enable sliding said third segment into position between said two segments and co-circumferential therewith.

9. Apparatus as in claim 7 wherein said cylindrical seal housing further includes a bottom section having a cylindrical base and a narrower, cylindrical boss extending upwardly within an inner circumference of the support ring in the annulus, and a cylindrical top section for attachment to the top of the central section.

10. Apparatus as in claim 9 wherein said annulus further includes an upper annular ridge upstanding from the top of the sidewall, and a lower annular ridge depending from the bottom of the sidewall, wherein the base of the bottom section includes an annular groove circumscribing the boss for receiving the lower annular ridge to hold the bottom section to the central section, and wherein the top section includes an annular groove for receiving the upper annular ridge to hold the top section to the central section.

11. Apparatus as in claim 1 wherein said first passageway extends generally vertically between the hopper and the discharge nozzle, and wherein the second passageway extends from the first passageway laterally and downwardly and then laterally to the dosing cylinder.

12. A sealing system for a liquid/flowable product filling apparatus which comprises a hopper for holding the product, and at least one filling assembly, each of which includes a nozzle, a cylinder, a valve for selectively passing product from the hopper to the cylinder and from the cylinder to the nozzle, a piston selectively moveable in the cylinder to draw product from the hopper through the valve into the cylinder or to push product from the cylinder into the valve and out of the nozzle, and a plunger selectively moveable in the valve to prevent the flow of product from the hopper into the valve or prevent the flow of product from the valve and out of the nozzle, said system including an annular piston seal circumscribing the piston to press against the cylinder walls, the piston seal comprising:

a resilient annulus having a sidewall with upper and lower, vertically spaced-apart, inwardly projecting lips, and a support ring comprised of three arcuate segments which, when placed end-to-end, form a ring for disposition within the annulus, between the upper and lower lips and against the sidewall, wherein the valve includes an annular wall section through which the plunger moves, and an annular recess formed in the wall section, and an annular valve seal disposed in the recess to press against the plunger as it moves through the wall section.

13. A sealing system as in claim 12 wherein the support ring of the piston seal further includes at least one annular recess formed on the exterior convex surface of the support ring, and wherein the piston seal further comprises an O-ring for disposition in the annular recess of the support ring.

14. A sealing system as in claim 13 wherein the abutting ends of two of the segments are formed with mating surfaces which are perpendicular to a tangent of the arcuate segments at a position at which the ends abut, wherein the opposite ends of the two segments are formed with surfaces parallel to one another and to the mating surfaces, and wherein the ends of the third segment are formed with surfaces parallel to one another and to the surfaces at the opposite ends of the two segments, for mating with respective surfaces of said opposite ends of the two segments when inserted therebetween, to complete the support ring.

15. A sealing system as in claim 14 wherein said piston seal further includes a lower section having a cylindrical base and an upwardly projecting cylindrical boss which is smaller in diameter than that of the base, said boss being dimensioned for fitting within the support ring in the annulus, and an upper cylindrical section for attachment to the top of the annulus.

16. A sealing system as in claim 12 wherein said valve seal includes an annular seal element having a U-shaped cross-section whose opening faces radially outwardly, and having an interior annular wall disposed radially inwardly from the opening, an annular support collar disposed in the opening of the seal element, said support collar including an inwardly facing annular groove which circumscribes the interior annular wall of the seal element, and a resilient O-ring disposed in the groove of the support collar to press against the interior wall of the seal element and force it radially inwardly against the exterior wall of the plunger.

* * * * *